US009378727B2

(12) United States Patent
Ye et al.

(10) Patent No.: US 9,378,727 B2
(45) Date of Patent: Jun. 28, 2016

(54) METHOD AND APPARATUS FOR AUDIO PLAYING

(71) Applicant: TENCENT TECHNOLOGY (SHENZHEN) COMPANY LIMITED, Shenzhen (CN)

(72) Inventors: Yinghua Ye, Shenzhen (CN); Yuejiao Hou, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 134 days.

(21) Appl. No.: 14/307,700

(22) Filed: Jun. 18, 2014

(65) Prior Publication Data

US 2014/0324436 A1 Oct. 30, 2014

Related U.S. Application Data

(63) Continuation of application No. PCT/CN2014/074123, filed on Mar. 26, 2014.

(30) Foreign Application Priority Data

Apr. 27, 2013 (CN) ..... 2013 1 0152992

(51) Int. Cl.
*G10L 13/00* (2006.01)

(52) U.S. Cl.
CPC ..... *G10L 13/00* (2013.01)

(58) Field of Classification Search
CPC ..... G10L 13/00
USPC ..... 704/260
See application file for complete search history.

(56) References Cited

U.S. PATENT DOCUMENTS

| | | | | |
|---|---|---|---|---|
| 7,779,357 | B2 * | 8/2010 | Naik | G06F 9/4443 715/716 |
| 8,239,202 | B2 | 8/2012 | Hsiao | |
| 2001/0015972 | A1 | 8/2001 | Horiguchi et al. | |

FOREIGN PATENT DOCUMENTS

| | | |
|---|---|---|
| CN | 102629936 | 8/2012 |

OTHER PUBLICATIONS

Tencent Technology (Shenzhen) Company Limited; PCT/CN2014/074123 filed on Mar. 26, 2014; International Search Report on Patentability and Written Opinion of the International Searching Authority; mailed on Jul. 8, 2014; The State Intellectual Property Office of the P.R. China (ISA/CN); 14 pages.

* cited by examiner

*Primary Examiner* — Susan McFadden
(74) *Attorney, Agent, or Firm* — Peter Su; Dentons US LLP

(57) ABSTRACT

A method and apparatus for audio playing is provided. The method includes receiving an audio conversion request carrying a first text identifier, and obtaining a first electronic text corresponding to the first text identifier; obtaining the audio data corresponding to the characters in the first electronic text according to a correspondence between characters and audio data which is stored in advance; and playing the audio data in the order of corresponding characters in the first electronic text. By applying the present disclosure, it is possible to improve the efficiency of obtaining information from electronic text.

13 Claims, 2 Drawing Sheets

METHOD AND APPARATUS FOR AUDIO PLAYING

CROSS REFERENCE TO RELATED APPLICATIONS

This application is a continuation application of PCT Patent Application No. PCT/CN2014/074123, entitled "METHOD AND APPARATUS FOR AUDIO PLAYING," filed on Mar. 26, 2014, which claims priority benefit of Chinese Patent Application No. 201310152992.5, entitled "METHOD AND APPARATUS FOR AUDIO PLAYING," filed on Apr. 27, 2013, the disclosures of which are herein incorporated by reference in their entireties.

TECHNICAL FIELD

The present disclosure relates to the field of computer technology, and in particular to a method and apparatus for audio playing.

BACKGROUND ART

With the fast development of computer technology and network technology, the amount of information provided by electronic devices such as mobile phones, computers and so on through the Internet is increasing explosively. Electronic information is stepping into people's life progressively, and is gradually replacing conventional books, newspapers, magazines and so on.

Electronic text is a very common carrier for electronic information. For example, electronic books present the content of books in the form of electronic text to users; network news is also mainly provided to users in the form of electronic text; email, instant messenger software or the like also mainly present information through electronic text; and so on. Users may read electronic text to obtain corresponding information.

SUMMARY OF THE DISCLOSURE

Electronic text is presented through screen displaying such that people need to obtain corresponding information from the electronic text through reading. In this process, users may not obtain corresponding information after reading the text due to outside disturbance or the users' lack of concentration; therefore, it is necessary to repeat the process of obtaining information, which reduces the efficiency of obtaining information from electronic text.

In view of the above, embodiments of the present disclosure provide a method and apparatus for audio playing in order to improve the efficiency of obtaining information from electronic text.

A first aspect of the present disclosure provides a method for audio playing, wherein a correspondence between characters and audio data is pre-stored in a non-transitory storage unit. The method comprises steps of receiving, by a receiving unit using a processor, an audio conversion request carrying a first text identifier, and obtaining a first electronic text corresponding to the first text identifier; obtaining, by an obtaining unit using a processor, the audio data corresponding to the characters in the first electronic text according to the stored correspondence between characters and audio data; and playing, by a playing unit using a processor, the audio data in the order of corresponding characters in the first electronic text.

In an example, the step of playing the audio data in the order of corresponding characters in the first electronic text comprises playing the audio data in the order of corresponding characters in the first electronic text when an audio playing request is received.

In an example, the audio conversion request is triggered by a first control signal, and the audio playing request is triggered by a second control signal.

In an example, the first control signal is a signal generated by clicking an earphone play button for a time duration larger than or equal to a preset threshold, and the second control signal is a signal generated by clicking the earphone play button for a time duration smaller than the preset threshold.

In an example, the first control signal is a signal generated by clicking an earphone play button for a time duration smaller than a preset threshold, and the second control signal is a signal generated by clicking the earphone play button for a time duration larger than or equal to the preset threshold.

In an example, after the step of receiving an audio conversion request carrying a first text identifier, and obtaining a first electronic text corresponding to the first text identifier, the method further comprises when a backward switch request is received, obtaining a second electronic text adjacent to and before the first electronic text; obtaining the audio data corresponding to the characters in the second electronic text according to the stored correspondence between characters and audio data; playing the audio data in the order of corresponding characters in the second electronic text; or, when a forward switch request is received, obtaining a third electronic text adjacent to and after the first electronic text; obtaining the audio data corresponding to the characters in the third electronic text according to the stored correspondence between characters and audio data; and playing the audio data in the order of corresponding characters in the third electronic text.

In an example, the backward switch request is triggered by a third control signal, and the forward switch request is triggered by a fourth control signal.

In an example, the third control signal is a signal generated by clicking a volume decreasing button, and the fourth control signal is a signal generated by clicking a volume increasing button.

In an example, the third control signal is a signal generated by clicking a volume increasing button, and the fourth control signal is a signal generated by clicking a volume decreasing button.

A second aspect of the present disclosure provides an apparatus for audio playing, comprising a storage unit configured to pre-store a correspondence between characters and audio data; a receiving unit using a processor and configured to receive an audio conversion request carrying a first text identifier, and obtain a first electronic text corresponding to the first text identifier; an obtaining unit using a processor and configured to obtain the audio data corresponding to the characters in the first electronic text according to the stored correspondence between characters and audio data; and a playing unit using a processor and configured to play the audio data in the order of corresponding characters in the first electronic text.

In an example, the playing unit is further configured to play the audio data in the order of corresponding characters in the first electronic text when an audio playing request is received.

In an example, the audio conversion request is triggered by a first control signal, and the audio playing request is triggered by a second control signal.

In an example, the first control signal is a signal generated by clicking an earphone play button for a time duration larger than or equal to a preset threshold, and the second control signal is a signal generated by clicking the earphone play button for a time duration smaller than the preset threshold.

In an example, the first control signal is a signal generated by clicking an earphone play button for a time duration smaller than a preset threshold, and the second control signal is a signal generated by clicking the earphone play button for a time duration larger than or equal to the preset threshold.

In an example, after receiving an audio conversion request carrying a first text identifier, and obtaining a first electronic text corresponding to the first text identifier, the receiving unit is further configured to when a backward switch request is received, obtain a second electronic text adjacent to and before the first electronic text; obtain the audio data corresponding to the characters in the second electronic text according to the stored correspondence between characters and audio data; play the audio data in the order of corresponding characters in the second electronic text; or, when a forward switch request is received, obtain a third electronic text adjacent to and after the first electronic text; obtain the audio data corresponding to the characters in the third electronic text according to the stored correspondence between characters and audio data; and play the audio data in the order of corresponding characters in the third electronic text.

In an example, the backward switch request is triggered by a third control signal, and the forward switch request is triggered by a fourth control signal.

In an example, the third control signal is a signal generated by clicking a volume decreasing button, and the fourth control signal is a signal generated by clicking a volume increasing button.

In an example, the third control signal is a signal generated by clicking a volume increasing button, and the fourth control signal is a signal generated by clicking a volume decreasing button.

A third aspect of the present disclosure also provides a terminal device comprising the apparatus for audio playing provided in the second aspect of the present disclosure.

A fourth aspect of the present disclosure also provides a non-transitory computer readable storage medium having stored thereon program instructions which, when executed on a computing device, instruct the computing device to perform respective steps of the method for audio playing in the first aspect of the present disclosure.

The benefits brought about by the solutions provided in embodiments of the present disclosure are as follows. It is possible to reduce the possibility of repeating the process of obtaining information and thus improve the efficiency of obtaining information from electronic text by presenting information recorded in electronic text through playing audio.

BRIEF DESCRIPTION OF THE DRAWINGS

In order to explain technical solutions in embodiments of the present disclosure more clearly, simple introduction of attached drawings needed to be used in the description of embodiments is given below. The attached drawings in the description below are only some embodiments of the present disclosure. For those ordinarily skilled in the art, other drawings may be obtained according to these attached drawings without inventive efforts, in which.

DETAILED DESCRIPTION OF THE EMBODIMENTS

In the following, respective embodiments of the present disclosure are further described in detail in relation to the attached drawings.

Figure 1:
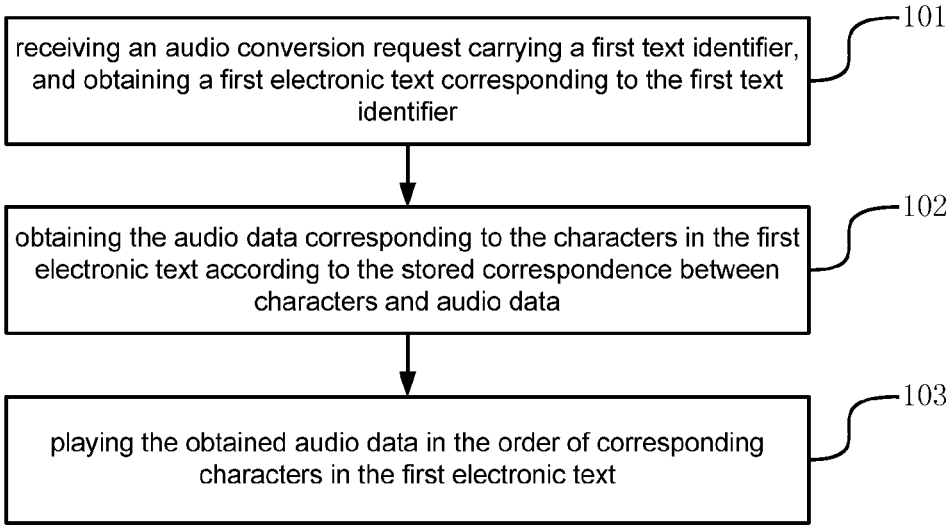
FIG. 1 is a flowchart of a method for audio playing provided by an embodiment of the present disclosure.

An embodiment of the present disclosure provides a method for audio playing. In this method, a correspondence between characters and audio data is pre-stored. As shown in FIG. 1, the process flow of the method may comprise the following steps: a step 101 of receiving an audio conversion request carrying a first text identifier, and obtaining a first electronic text corresponding to the first text identifier, a step 102 of obtaining the audio data corresponding to the characters in the first electronic text according to the stored correspondence between characters and audio data, and a step 103 of playing the obtained audio data in the order of corresponding characters in the first electronic text.

In the embodiment of the present disclosure, an audio conversion request carrying a first text identifier is received, a first electronic text corresponding to the first text identifier is obtained, the audio data corresponding to the characters in the first electronic text is obtained according to the stored correspondence between characters and audio data, and then the obtained audio data is played in the order of corresponding characters in the first electronic text. In this way, it is possible to reduce the possibility of repeating the process of obtaining information and thus improve the efficiency of obtaining information from electronic text by obtaining information recorded in the electronic text through playing audio.

The executing body of the method for audio playing provided in the above embodiment of the present disclosure may be an electronic device with some processing capability and audio playing function, which is preferably a terminal such as a cell phone, a pad computer, etc. The following embodiments will be described by taking the terminal as an example. In the method, a correspondence between characters and audio data is pre-stored. The characters may include characters, words, phrases, sentences, paragraphs, etc., in any language. The audio (voice) data is the audio data of the character pronunciation corresponding to the characters. In particular, an audio database may be built to store the audio data. The above correspondence may be used to index the audio data in the audio database. The above audio database may be located in a local terminal. It may also be located in a server in the network, and may be accessed by the terminal from the server through the network when being used.

In the following, the process flow shown in FIG. 1 is described in detail in connection with specific embodiments as follows.

At step 101, an audio conversion request carrying a first text identifier is received, and a first electronic text corresponding to the first text identifier is obtained.

The audio conversion request may request converting the electronic text into audio data. The electronic text is text data stored digitally. It may be electronic books, text documents, text in network news, text in emails, text in instant messenger software, or the like. A text identifier may uniquely correspond to one electronic text. A terminal may record the correspondence between the text identifier and the electronic text. Thus, it is possible to retrieve the storage position of the electronic text through the text identifier.

In this step, the audio conversion request may be triggered by a control signal. The control signal may be a signal generated by the user operating the terminal. That is, the audio conversion request may be generated by the user operating the terminal. In particular, the audio conversion request may be triggered by a first control signal, which may be a signal generated by clicking any preset button. Preferably, the first control signal may be a signal generated by clicking an earphone play button for a time duration larger than or equal to a preset threshold. That is, the first control signal may be a signal generated by the user pressing the earphone play button for a long time. Alternatively, the first control signal may be a signal generated by clicking a button on the terminal screen, or a signal generated by clicking a button on the terminal body.

In addition, the audio conversion request may be triggered by other trigger events. When the audio conversion of one electronic text is finished, the audio conversion request for the next electronic text adjacent thereto may be generated. For example, when an electronic book is displayed, the audio conversion may be performed for the electronic text in every page of the electronic book in sequence. When the audio conversion for the electronic text in the first page is finished, the audio conversion request for the electronic text in the second page may be generated. The same action applies to the subsequent pages.

Further, the audio conversion request for the electronic texts contained in a page may be generated when the system activates the page. It is also possible that, when a new electronic text is displayed in a page, the audio conversion request corresponding to the new electronic text is generated. For example, when instant messenger software receives a new chatting content sent from the other side, the audio conversion request corresponding to the new chatting content is generated.

When the audio conversion request is generated, the first text identifier carried therein may be the text identifier corresponding to the electronic text displayed in the current page. If the page displays multiple electronic texts such as multiple pieces of news in the news page, the first text identifier may indicate the first electronic text displayed in the page, such as the electronic text displayed on the most up-left of the page.

At step 102, the audio data corresponding to the characters in the first electronic text is obtained according to the stored correspondence between characters and audio data.

In the process, first, a segmentation process may be performed for the first electronic text. The first electronic text may be segmented into multiple characters, which may be characters, words, phrases or the like. Then the audio data corresponding to each character may be obtained according to the pre-stored correspondence between characters and audio data. Here, when the audio data corresponding to each character is obtained, the audio data corresponding to each character may be obtained in the order of respective characters in the first electronic text.

At step 103, the obtained audio data is played in the order of corresponding characters in the first electronic text.

Specifically, step 103 may start to be performed after the audio data corresponding to all the characters in the first electronic text is obtained in step 102, may start to be performed after the audio data corresponding to the first character in the first electronic text is obtained, or may start to be performed after the audio data corresponding to a preset number of characters in the first electronic text is obtained. Further, step 103 may start to be performed when the audio playing for the previous electronic text (e.g. the previous page of an electronic book or the previous piece of news in the news page) adjacent to the first electronic text is finished. For example, the audio playing for an electronic book is performed page by page, or the audio playing for the news in a news page is performed piece by piece.

In the embodiment, the obtained audio data may be played in the order of corresponding characters in the first electronic text when an audio playing request is received. The audio playing request may be triggered by a second control signal, which may be a signal generated by clicking any preset button. Preferably, the second control signal may be a signal generated by clicking an earphone play button for a time duration smaller than a preset threshold. That is, the second control signal may be a signal generated by the user pressing the earphone play button for a short time. Alternatively, the second control signal may be a signal generated by clicking a button on the terminal screen, or a signal generated by clicking a button on the terminal body.

According to an embodiment of the present disclosure, the scope of the present disclosure is not limited by the specific forms of the first control signal and the second control signal. For example, it is possible to configure the first control signal as a signal generated by the user pressing the earphone play button for a short time and configure the second control signal as a signal generated by the user pressing the earphone play button for a long time.

In an embodiment of the present disclosure, after performing step 101, if a backward switch request or a forward switch request is received, the following process 1 or 2 may be performed.

Process 1: when a backward switch request is received, a second electronic text adjacent to and before the first electronic text is obtained, the audio data corresponding to the characters in the second electronic text is obtained according to the stored correspondence between characters and audio data, and the obtained audio data is played in the order of corresponding characters in the second electronic text.

The backward switch request may request switching an electronic text for which the audio conversion is to be performed from the current electronic text (i.e., the electronic text obtained in step 101) to the previous electronic text adjacent to the current electronic text, such as the previous page of an electronic book, the previous piece of news, or the like. The adjacency between electronic texts may refer to the adjacency with respect to the displaying order.

In the embodiment, when the backward switch request is received, if step 102 is being performed, the performance of step 102 may be stopped, and if step 103 is being performed, the performance of step 103 may be stopped.

Specifically, the backward switch request may be triggered by a third control signal, or may be triggered by other trigger events. The third control signal may be a signal generated by clicking any preset button. In the embodiment, the third control signal may be a signal generated by clicking a volume decreasing button, which may be a volume decreasing button on the terminal body or on the earphone. Alternatively, the third control signal may be a signal generated by clicking a button on the terminal screen, or a signal generated by clicking a button on the terminal body.

Process 2: when a forward switch request is received, a third electronic text adjacent to and after the first electronic text is obtained, the audio data corresponding to the characters in the third electronic text is obtained according to the stored correspondence between characters and audio data, and the obtained audio data is played in the order of corresponding characters in the third electronic text.

The forward switch request may request switching an electronic text for which the audio conversion is to be performed from the current electronic text (i.e., the electronic text obtained in step 101) to the next electronic text adjacent to the current electronic text, such as the next page of an electronic book, the next piece of news, or the like.

In the embodiment, when the forward switch request is received, if step 102 is being performed, the performance of step 102 may be stopped, and if step 103 is being performed, the performance of step 103 may be stopped.

Specifically, the forward switch request may be triggered by a fourth control signal, or may be triggered by other trigger events. The fourth control signal may be a signal generated by clicking any preset button. Preferably, the fourth control signal may be a signal generated by clicking a volume increasing button, which may be a volume increasing button on the terminal body or on the earphone. Alternatively, the fourth control signal may be a signal generated by clicking a button on the terminal screen, or a signal generated by clicking a button on the terminal body.

According to an embodiment of the present disclosure, the scope of the present disclosure is not limited by the specific forms of the third control signal and the fourth control signal. For example, it is possible to configure the third control signal as a signal generated by clicking a volume increasing button, and configure the fourth control signal as a signal generated by clicking a volume decreasing button.

In the embodiment of the present disclosure, an audio conversion request carrying a first text identifier is received, a first electronic text corresponding to the first text identifier is obtained, the audio data corresponding to the characters in the first electronic text is obtained according to the stored correspondence between characters and audio data, and then the obtained audio data is played in the order of corresponding characters in the first electronic text. In this way, it is possible to reduce the possibility of repeating the process of obtaining information and thus improve the efficiency of obtaining information from electronic text by obtaining information recorded in the electronic text through playing audio.

Figure 2:
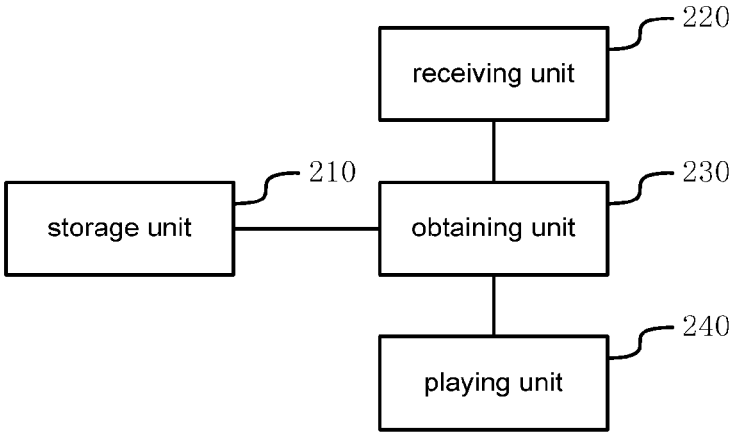
FIG. 2 is a structure schematic diagram of an apparatus for audio playing provided by another embodiment of the present disclosure.

Based on the same technical concept, another embodiment of the present disclosure provides an apparatus for audio playing as shown in FIG. 2. The apparatus comprises a storage unit 210 configured to pre-store a correspondence between characters and audio data; a receiving unit 220 configured to receive an audio conversion request carrying a first text identifier, and obtain a first electronic text corresponding to the first text identifier; an obtaining unit 230 configured to obtain the audio data corresponding to the characters in the first electronic text according to the stored correspondence between characters and audio data; and a playing unit 240 configured to play the obtained audio data in the order of corresponding characters in the first electronic text.

In the embodiment, the playing unit 240 is further configured to play the obtained audio data in the order of corresponding characters in the first electronic text when an audio playing request is received.

In the embodiment, the audio conversion request is triggered by a first control signal, and the audio playing request is triggered by a second control signal.

In the embodiment, the first control signal is a signal generated by clicking an earphone play button for a time duration larger than or equal to a preset threshold, and the second control signal is a signal generated by clicking the earphone play button for a time duration smaller than the preset threshold.

In the embodiment, the first control signal is a signal generated by clicking an earphone play button for a time duration smaller than a preset threshold, and the second control signal is a signal generated by clicking the earphone play button for a time duration larger than or equal to the preset threshold.

In the embodiment, after receiving an audio conversion request carrying a first text identifier, and obtaining a first electronic text corresponding to the first text identifier, the receiving unit is further configured to when a backward switch request is received, obtain a second electronic text adjacent to and before the first electronic text; obtain the audio data corresponding to the characters in the second electronic text according to the stored correspondence between characters and audio data; play the obtained audio data in the order of corresponding characters in the second electronic text; or, when a forward switch request is received, obtain a third electronic text adjacent to and after the first electronic text; obtain the audio data corresponding to the characters in the third electronic text according to the stored correspondence between characters and audio data; and play the obtained audio data in the order of corresponding characters in the third electronic text.

In the embodiment, the backward switch request is triggered by a third control signal, and the forward switch request is triggered by a fourth control signal.

In the embodiment, the third control signal is a signal generated by clicking a volume decreasing button, and the fourth control signal is a signal generated by clicking a volume increasing button.

In the embodiment, the third control signal is a signal generated by clicking a volume increasing button, and the fourth control signal is a signal generated by clicking a volume decreasing button.

In the embodiment of the present disclosure, an audio conversion request carrying a first text identifier is received, a first electronic text corresponding to the first text identifier is obtained, the audio data corresponding to the characters in the first electronic text is obtained according to the stored correspondence between characters and audio data, and then the obtained audio data is played in the order of corresponding characters in the first electronic text. In this way, it is possible to reduce the possibility of repeating the process of obtaining information and thus improve the efficiency of obtaining information from electronic text by obtaining information recorded in the electronic text through playing audio.

Figure 3:
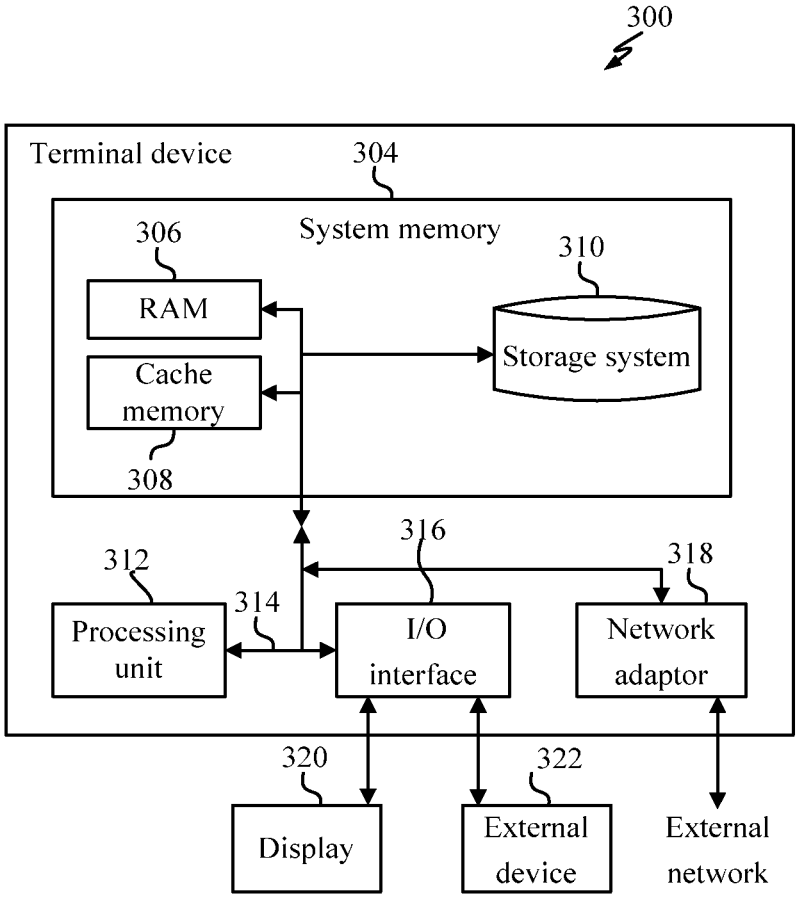
FIG. 3 is a diagram illustrating the structure of a terminal device for implementing the embodiments of the present disclosure.

FIG. 3 is a diagram illustrating the structure of a terminal device for implementing the embodiments of the present disclosure.

The terminal device 300 shown in FIG. 3 is only an example and does not limit the functionality and the scope of use of embodiments of the disclosure. As shown in FIG. 3, the terminal device 300 may be in a form of a general purpose computing device. Components of the terminal device 300 may include, but are not limited to, one or more processors or processing units 312, a system memory 304, an input/output (I/O) interface 316, a network adapter 318, a display 320 and a bus 314 that couples various components, and the terminal device 300 may be connected to an external device 322.

The bus 314 represents one or more of several types of bus structures. For example, such bus structures include, but are not limited to, Industry Standard Architecture (ISA) bus, Micro Channel Architecture (MCA) bus, Enhanced ISA (EISA) bus, Video Electronics Standards Association (VESA) local bus, Peripheral Component Interconnect (PCI) bus, and so on.

The terminal device 300 typically includes a variety of computer system readable media. Such a medium may be any readable medium that is accessible by the terminal device 300, and it includes both volatile and non-volatile media, and both removable and non-removable media.

The system memory 304 may include readable media in the form of volatile memory, such as random access memory (RAM) 306 and/or cache memory 308. The terminal device 300 may further include other removable/non-removable, volatile/non-volatile storage media. For example, the storage system 310 (typically called a "hard drive") may be provided for reading from and writing to a non-removable, non-volatile magnetic medium. Although not shown in FIG. 3, a magnetic disk drive for reading from and writing to a removable, non-volatile magnetic disk (e.g., a "soft disk") and an optical disk drive for reading from or writing to a removable, non-volatile optical disk such as a CD-ROM, DVD-ROM or other optical media may be provided. In such instances, each drive may be connected to the bus 314 by one or more data medium interfaces.

The system memory 304 may include at least one program product having a set (for example, at least one) of program modules, which may be stored in the storage system 310. The program module contains a computer executable program instruction. Such program modules are configured to perform functions of respective embodiments of the present disclosure by the processing units 312 executing the program instruction therein. Such program modules include, but are not limited to, an operating system, one or more application programs, other program modules, and program data. Each of these examples of program modules or some combination thereof may include an implementation of a networking environment.

The terminal device 300 may also communicate with one or more external devices 322 such as a keyboard, a mouse, the display 320, etc., and communicate with one or more devices that enable a user to interact with the terminal device 300. Such communication may occur via the Input/Output (I/O) interface 316. Further, the terminal device 300 may also communicate with one or more networks such as a local area network (LAN), a general wide area network (WAN), and/or a public network (e.g., the Internet) via the network adapter 318 such as a network card, modem, etc. As shown in FIG. 3, the I/O interface 316 and the network adapter 318 communicate with the other modules of the terminal device 300 via the bus 314. It should be understood that, although not shown, other hardware and/or software modules may be used in conjunction with the terminal device 300. Such other hardware and/or software modules include, but are not limited to microcode, device drivers, redundant processing units, external disk drive arrays, RAID systems, tape drives, and data archival storage systems, etc.

Respective units such as storage unit 210, receiving unit 220, obtaining unit 230 and playing unit 240 in respective embodiments of the present disclosure may be program modules having computer program instructions, which are stored in the system memory 304, and implemented by the one or more processors or processing units 312, to perform the method illustrated in FIG. 1.

It is noted that respective units contained in the apparatus for audio playing provided in the above respective embodiments are described only by taking the division of above respective functional modules as an example. In a practical application, the above functions may be assigned as needed to different functional modules to be performed, that is, the internal structure of the apparatus may be divided into different functional modules to perform all or part of the functions as described above. Further, the apparatuses for audio playing provided in the above embodiments and method embodiments for audio playing belong to the same concept, and the specific implementation of the apparatuses may refer to the method embodiments, and unnecessary details will no longer be given here.

The embodiment numbers of the present disclosures as described above are only for the purpose of description and do not represent the inferiority or superiority of the embodiments.

It may be understood by those ordinarily skilled in the art that all or part of the steps for implementing the above embodiments may be implemented by hardware or by the related hardware instructed by a program, which may be stored in a computer readable storage medium, which may be a read only memory, a magnetic disk, an optical disc or the like.

The above description is only preferable embodiments of the present disclosure and is not intended to limit the protection scope of the present disclosure. Any modification, equivalent replacement, enhancement, or the like within the spirit and principle of the present disclosure should all be contained within the protection scope of the present disclosure.

What is claimed is:

1. A method for audio playing having a correspondence between characters and pre-stored audio data in a non-transitory storage unit, comprising:

receiving an audio conversion request carrying a first text identifier and obtaining a first electronic text corresponding to the first text identifier, by a receiving unit using a processor;

obtaining, by a obtaining unit using a processor, the audio data corresponding to the characters in the first electronic text according to the stored correspondence between characters and audio data; and playing, by a playing unit using a processor, the audio data in an order of corresponding characters in the first electronic text, wherein the audio conversion request is triggered by a first control signal, and the audio playing request is triggered by a second control signal, wherein the first control signal is a signal generated by clicking an earphone play button for a time duration larger than or equal to a preset threshold, and the second control signal is a signal generated by clicking the earphone play button for a time duration smaller than the preset threshold; or the first control signal is a signal generated by clicking an earphone play button for a time duration smaller than a preset threshold, and the second control signal is a signal generated by clicking the earphone play button for a time duration larger than or equal to the preset threshold.

2. The method according to claim 1, wherein the step of playing the obtained audio data in the order of corresponding characters in the first electronic text comprises:

playing the audio data in the order of corresponding characters in the first electronic text when an audio playing request is received.

3. The method according to claim 1, wherein after the step of receiving an audio conversion request carrying a first text identifier, and obtaining a first electronic text corresponding to the first text identifier, the method comprises:

when a backward switch request is received, obtaining a second electronic text adjacent to and before the first electronic text; obtaining the audio data corresponding to the characters in the second electronic text according to the stored correspondence between characters and audio data; playing the audio data in the order of corresponding characters in the second electronic text, or when a forward switch request is received, obtaining a third electronic text adjacent to and after the first electronic text; obtaining the audio data corresponding to the characters in the third electronic text according to the stored correspondence between characters and audio data; playing the audio data in the order of corresponding characters in the third electronic text.

4. The method according to claim 3, wherein the backward switch request is triggered by a third control signal, and the forward switch request is triggered by a fourth control signal.

5. The method according to claim 4, wherein the third control signal is a signal generated by clicking a volume decreasing button, and the fourth control signal is a signal generated by clicking a volume increasing button.

6. The method according to claim 4, wherein the third control signal is a signal generated by clicking a volume increasing button, and the fourth control signal is a signal generated by clicking a volume decreasing button.

7. An apparatus for audio playing, comprising:

a storage unit configured to pre-store a correspondence between characters and audio data;

a receiving unit using a processor and configured to receive an audio conversion request carrying a first text identifier, and obtain a first electronic text corresponding to the first text identifier;

an obtaining unit using a processor and configured to obtain the audio data corresponding to the characters in the first electronic text according to the stored correspondence between characters and audio data; and a playing unit using a processor and configured to play the audio data in the order of corresponding characters in the first electronic text, wherein the audio conversion request is triggered by a first control signal, and the audio playing request is triggered by a second control signal, wherein the first control signal is a signal generated by clicking an earphone play button for a time duration larger than or equal to a preset threshold, and the second control signal is a signal generated by clicking the earphone play button for a time duration smaller than the preset threshold; or the first control signal is a signal generated by clicking an earphone play button for a time duration smaller than a preset threshold, and the second control signal is a signal generated by clicking the earphone play button for a time duration larger than or equal to the preset threshold.

8. The apparatus according to claim 7, wherein the playing unit is configured to play the audio data in the order of corresponding characters in the first electronic text when an audio playing request is received.

9. The apparatus according to claim 7, wherein after receiving an audio conversion request carrying a first text identifier, and obtaining a first electronic text corresponding to the first text identifier, the receiving unit is further configured to:

when a backward switch request is received, obtain a second electronic text adjacent to and before the first electronic text; obtain the audio data corresponding to the characters in the second electronic text according to the stored correspondence between characters and audio data; play the audio data in the order of corresponding characters in the second electronic text, or when a forward switch request is received, obtain a third electronic text adjacent to and after the first electronic text; obtain the audio data corresponding to the characters in the third electronic text according to the stored correspondence between characters and audio data; play the audio data in the order of corresponding characters in the third electronic text.

10. The apparatus according to claim 9, wherein the backward switch request is triggered by a third control signal, and the forward switch request is triggered by a fourth control signal.

11. The apparatus according to claim 10, wherein the third control signal is a signal generated by clicking a volume decreasing button, and the fourth control signal is a signal generated by clicking a volume increasing button.

12. The apparatus according to claim 10, wherein the third control signal is a signal generated by clicking a volume increasing button, and the fourth control signal is a signal generated by clicking a volume decreasing button.

13. A non-transitory computer readable storage medium having stored thereon program instructions which, when executed on a computing device, instruct the computing device to perform respective steps of the method recited in claim 1.

* * * * *